US010974084B1

(12) United States Patent
Grinvald et al.

(10) Patent No.: US 10,974,084 B1
(45) Date of Patent: Apr. 13, 2021

(54) REUSABLE RESPIRATOR MASK WITH REFILLABLE FILTER

(71) Applicant: Castle Grade LLC, New York, NY (US)

(72) Inventors: Anna Grinvald, Dongguan (CN); Ron Grinvald, Dongguan (CN); David Chen, Dongguan (CN)

( * ) Notice: Subject to any disclaimer, the term of this patent is extended or adjusted under 35 U.S.C. 154(b) by 0 days.

(21) Appl. No.: 16/922,504

(22) Filed: Jul. 7, 2020

Related U.S. Application Data

(60) Provisional application No. 63/015,862, filed on Apr. 27, 2020.

(51) Int. Cl.
*A62B 23/02* (2006.01)
*A62B 18/02* (2006.01)
*A41D 13/11* (2006.01)

(52) U.S. Cl.
CPC ..... *A62B 23/025* (2013.01); *A41D 13/1138* (2013.01); *A62B 18/025* (2013.01)

(58) Field of Classification Search
CPC ..... A62B 23/00; A62B 23/02; A62B 23/025; A62B 7/10; A62B 18/025; A62B 18/02; A62B 18/084; A41D 13/11; A61M 16/0683
See application file for complete search history.

(56) References Cited

U.S. PATENT DOCUMENTS

| | | | | |
|---|---|---|---|---|
| 2,176,709 | A * | 10/1939 | Dym | A62B 18/084 128/207.11 |
| 2,791,216 | A * | 5/1957 | Churchill | A62B 18/025 128/206.17 |
| 6,817,362 | B2 * | 11/2004 | Gelinas | A62B 18/025 128/206.12 |
| 7,213,595 | B2 | 5/2007 | Capon | |
| 8,763,611 | B2 | 7/2014 | Seitz | |
| 9,457,207 | B2 | 10/2016 | Waterford | |
| 2013/0228184 | A1 * | 9/2013 | Lee | A62B 7/10 128/863 |
| 2015/0314148 | A1 * | 11/2015 | Waterford | A62B 18/084 128/863 |
| 2018/0236275 | A1 * | 8/2018 | Song | A62B 23/02 |

OTHER PUBLICATIONS

Spark R&D, Montana Mask, Mar. 2020, https://www.sparkrandd.com/spark-rd-montana-mask-information-page/.

* cited by examiner

*Primary Examiner* — Margaret M Luarca
(74) *Attorney, Agent, or Firm* — David M. Peer

(57) ABSTRACT

A reusable two-way respirator mask comprising a filter cover, a filter base, a facepiece, and a filter adapted to remove airborne pathogens. The facepiece is configured to interface with the face of the user and deform under moderate pressure to create a substantially airtight seal with the user's face. The filter cover and filter base a removably coupled such that the user may easily replace the filter by decoupling the filter cover and filter base. Both inhalation and exhalation pass through the filter, reducing the user's inhalation of pathogens and reducing the spread of pathogens from the user to others. The reusable two-way respirator mask is constructed of head resistant materials, suitable for repeated disinfecting.

6 Claims, 8 Drawing Sheets

REUSABLE RESPIRATOR MASK WITH REFILLABLE FILTER

CROSS REFERENCE TO RELATED APPLICATIONS

This application claims the benefit of U.S. Provisional Application No. 63/015,862, filed on Apr. 27, 2020.

BACKGROUND OF THE INVENTION

Respirator masks are worn by individuals throughout the world for a variety of reasons. Traditionally, respirator masks have been worn by workers in industrial settings to reduce the inhalation of particulate matters and by health care workers to reduce the spread of harmful pathogens. More recently, retail consumer demand for respirator masks has increased due to air pollution and forest fires. In response to the pandemic caused by the novel Coronavirus (Coronavirus), health agencies across the world have recommended that healthcare workers and vulnerable individuals wear respirator masks to avoid the contraction of and reduce the spread of the Coronavirus.

The respirator masks most commonly used by medical professionals and retail consumers are regarded as disposable and the extended or repeated reuse of such masks is not recommended by health agencies. In particular the respirator masks most commonly used by medical professionals do not have refillable filtration mediums and are not suited for disinfection. As disposable respirator masks have been discarded after use during the Coronavirus pandemic, supplies of respirator masks have dwindled. Reusable respirator masks are known in the art. For example, canister style respirator masks may allow for the replacement of filtration cartridges and may be more suited for disinfection, making canister style respirator masks more suitable for reuse. However, typical canister style masks are not suitable for health care workers, or the general population for use during a pandemic, for multiple reasons. First, canister style respirator masks typically only filter air being inhaled by the individual wearing the mask. Exhaled air is typically directed out of the mask through an unfiltered vent. Because the wearer's exhalation is not filtered, the wearer will freely spread pathogens. Second, canister style respirator masks are typically larger, heavier, and significantly more expensive than disposable respirator masks.

Therefore, a need exists for a novel respirator mask that is lightweight, inexpensive, and filters the wearer's inhalations and exhalations. For the purposes of this disclosure, the filtration of both inhalation and exhalation will be referred to as two-way filtration and a respirator the performs two-way filtration will be referred to as a two-way respirator.

BRIEF SUMMARY OF THE INVENTION

One aspect of the disclosure relates to a two-way respirator mask comprising at least a filter cover, a filter, a filter base, a facepiece, and a harness strap.

In preferred embodiments, the filter cover comprises a vent plate, a cover outside wall, a cover interior wall, and two lugs. The filter base comprises a base plate, a base wall, a base vent, and a facepiece interface. The filter cover and filter base are removably coupled to form a substantially airtight interface and the filter rests in a filter cavity bounded by the filter cover and filter base. The filter base is removably coupled to the facepiece to form a substantially airtight interface. The facepiece comprises a periphery, an inner surface, an outer surface, a filter base interface, and a facepiece cavity. The harness strap comprises two end portions and a middle portion. The end portions are configured to pass through the filter cover lugs and each additionally comprise a tip and a plurality of protrusions that will not pass through the filter cover lugs without the application of substantial force.

In preferred embodiments, the filter cover, filter base, facepiece, and harness strap are constructed of heat resistant materials, such that these components may be disinfected with hot water. The filter may be comprised of one or more layers of material that filter aerosols, pathogens, particulate matter, or toxic gases.

In preferred embodiments, a user may wear the two-way respirator mask by applying the periphery of the facepiece to the user's face and applying the harness strap to the back of the user's head. Air from the external environment to be inhaled by the user passes sequentially through vent holes in the vent plate, through the filter, through the base vent, into the facepiece cavity, and into the mouth or nose of the user. Exhaled air passes sequentially through the mouth or nose of the user, into the facepiece cavity, through the base vent, through the filter, and through the vent holes in the vent plate to the external environment.

These and other objects, features, and characteristics of the apparatus and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification in the claims, the singular form of "a", "an", and "the" include plural references unless the context clearly dictates otherwise.

DETAILED DESCRIPTION OF THE INVENTION

Various embodiments and aspects of the disclosure will be described with references to details discussed below, and the accompanying drawings will illustrate the various embodiments. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

Figure 1:
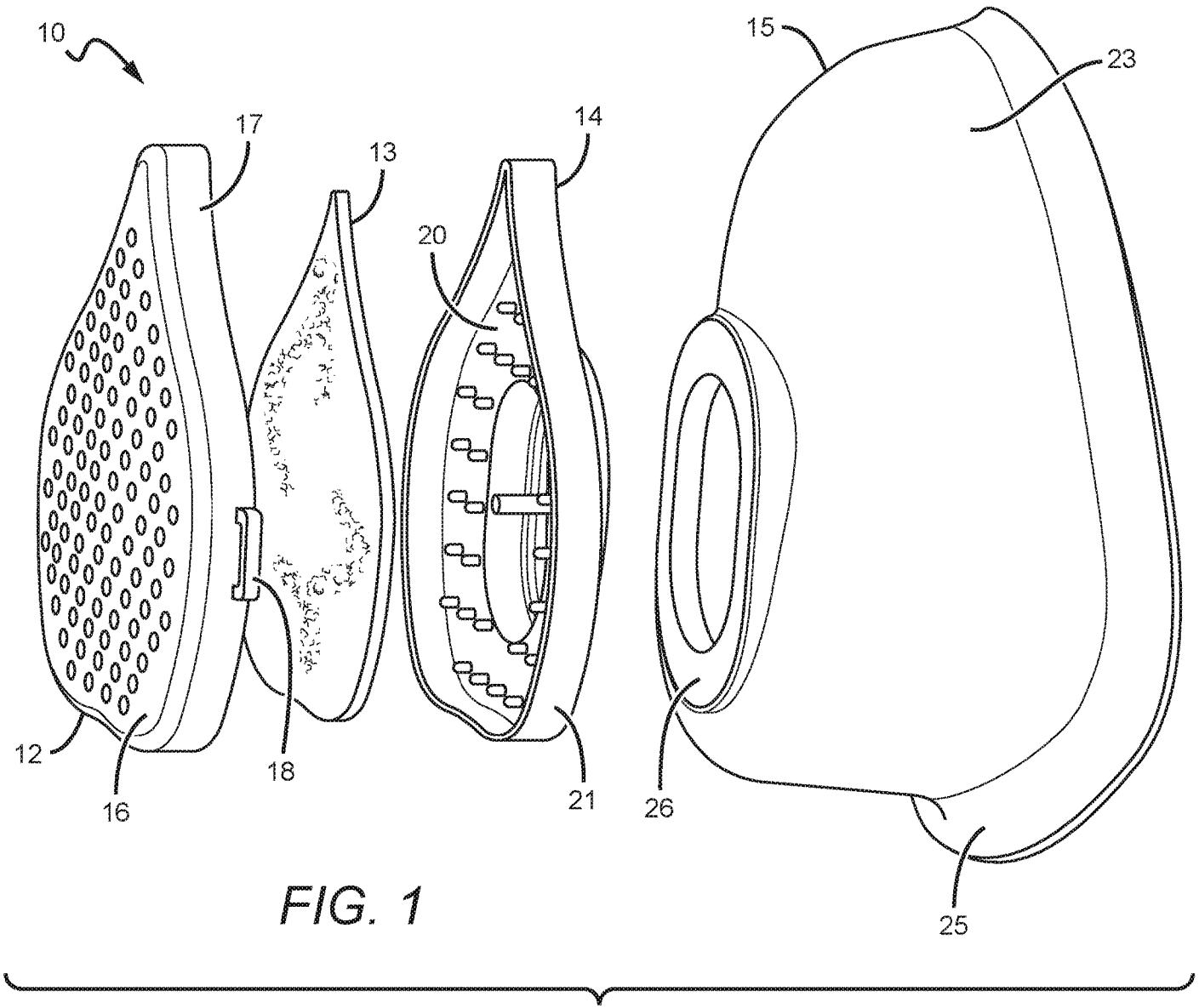
FIG. 1 is an exploded front-side perspective view of a two-way respirator mask according to the invention.
Figure 2:
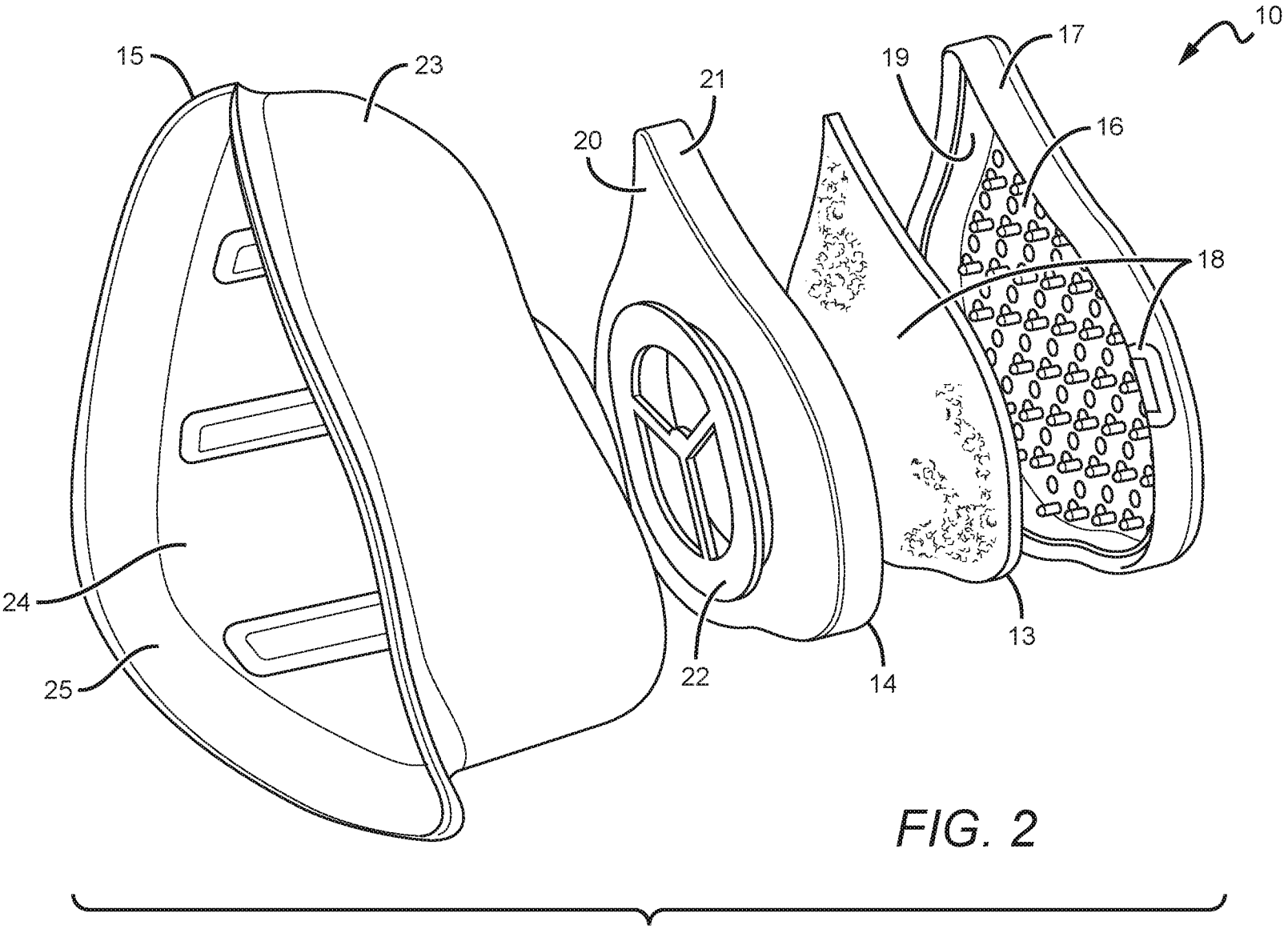
FIG. 2 is an exploded rear-side perspective view of a two-way respirator mask according to the invention.
Figure 3:
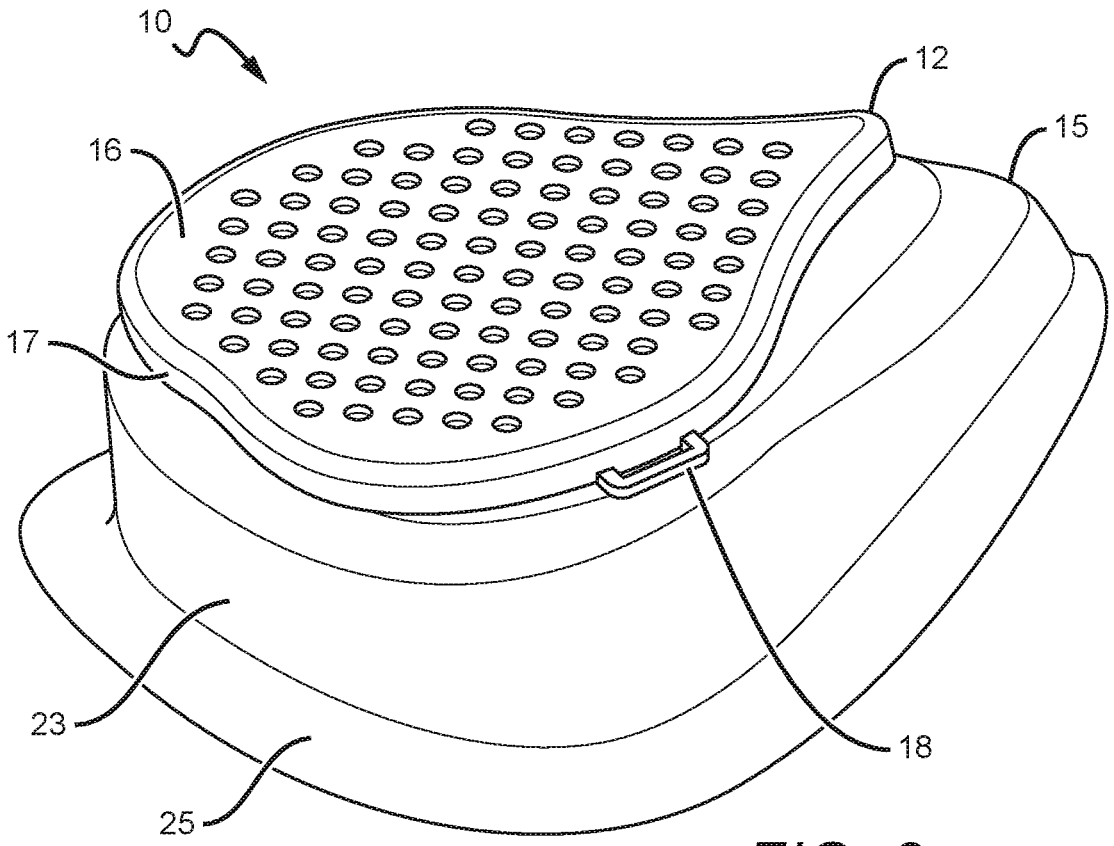
FIG. 3 is a front perspective view of a two-way respirator mask according to the invention.

A two-way respirator mask 10 according to the invention is shown in the drawings, beginning with FIGS. 1-3. The two-way respirator mask 10 may be referred to herein as the mask. The mask comprises a filter cover 12, a filter 13, a filter base 14, a facepiece 15, and a harness strap (not shown). In some embodiments, harness straps may not be necessary to secure the mask to the face of a user.

A filter cover may be a structure that protects a filtration medium and allows for air to pass back and forth between the outside environment and a filtration medium. A filter cover may also house various types of filtration medium and stabilize a filtration medium in place.

A preferred embodiment of a filter cover, filter cover 12, comprises vent plate 16, cover outside wall 17, lugs 18, and cover interior wall 19. Filter base 14 comprises base plate 20, base wall 21, and facepiece interface 22. Facepiece 15 comprises outer surface 23, inner surface 24, periphery 25, and filter base interface 26.

Figure 4:
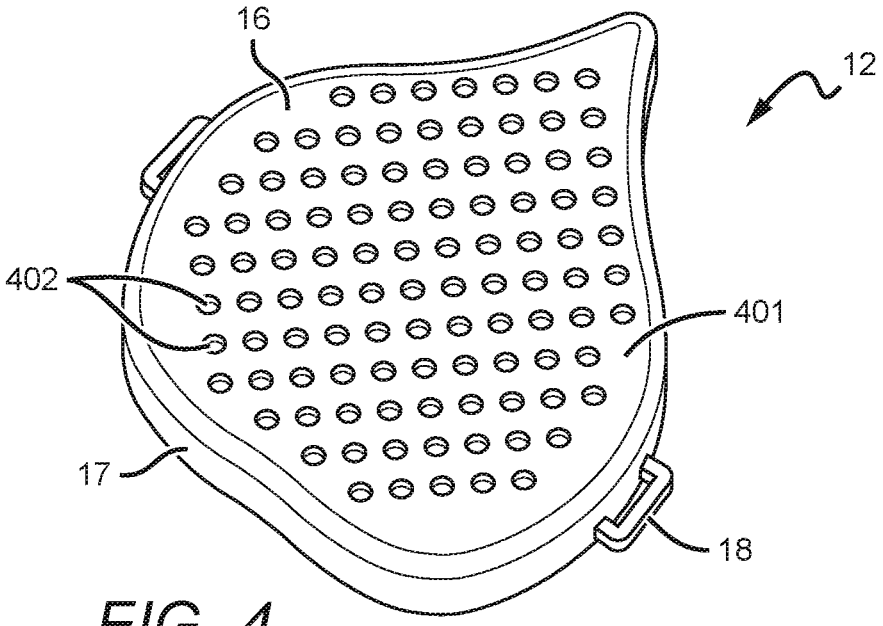
FIG. 4 is a front perspective view of a filter cover.
Figure 5:
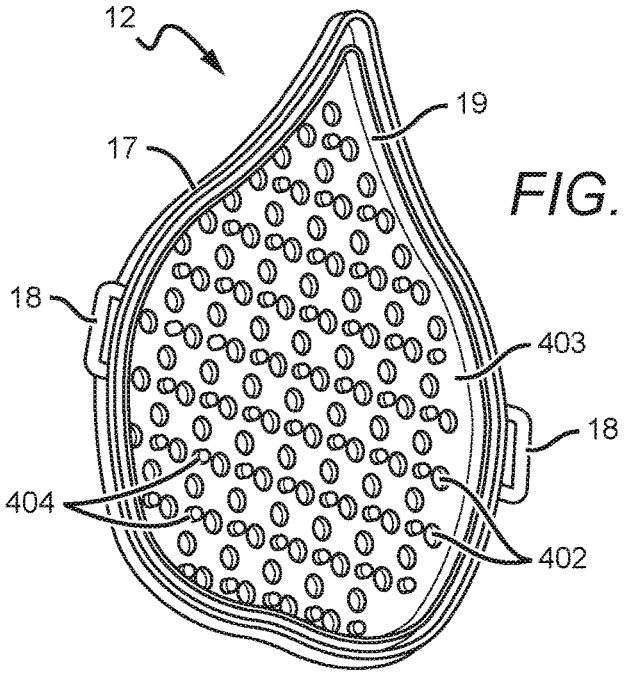
FIG. 5 is a rear perspective view of a filter cover.

FIGS. 4-5 illustrates a preferred embodiment of a filter cover 12. In preferred embodiments, vent plate 16 is a plate with a generally teardrop shaped perimeter. Vent plate's 16 perimeter is bounded by cover outside wall 17. The height of cover outside wall 17 extends substantially perpendicularly from vent plate 16. A plurality of lugs 18 are attached to the exterior face of cover outside wall 17. Lugs 18 are configured to receive the end portions 1302 of harness strap 1301. Filter cover 12 may serve a variety of functions including protecting filter 13 from damage, securing filter 13 in place, creating a substantially airtight seal with base cover 19, forming a filter cavity, and allowing for the replacement of filter 13.

Vent plate 16 further comprises exterior face 401, vent holes 402, interior face 403, and stabilizing protrusions 404. Preferably, vent holes 402 are numerous, small openings in vent plate 16. Numerous, small vent holes allow for optimal air flow, while protecting filter 13 from damage from impact or scratching. Nonetheless, vent holes 402 may be more or less numerous and come in a variety of shapes and sizes. It should be appreciated that a variety of vent or grate structures are known in the art that allow for air to flow through a filter while protecting said filter from damage and that such structures may be substituted for vent holes 402.

Cover interior wall 19 protrudes substantially perpendicularly from the interior face 403 of vent plate 16. Cover interior wall 19 and cover outside wall 17 are substantially parallel and are preferably of substantially equal height. Vent holes 402 and stabilizing protrusions 404 are preferably within the perimeter of inside wall 17. Stabilizing protrusions 404 protrude substantially perpendicularly from interior face 403. Preferably, filter stabilizing protrusions 404 are numerous, small, cylindrical protrusions that interface with filter 13 to prevent filter 13 from moving substantially during use of the mask. Numerous, small filter stabilizing protrusions allow for optimal air flow, while preventing filter 13 from moving during use. Nonetheless, filter stabilizing protrusions 402 may be more or less numerous and come in a variety of shapes and sizes. For example, two or more conical protrusions may be sufficient to stabilize filter 13. In alternative embodiments, filter stabilizing protrusions 404 may be omitted and filter 13 may be stabilized by the interface of its own structure with cover interior wall 19. Preferably, stabilizing protrusions 404 are long enough to make contact with filter 13, but not long enough to puncture or damage filter 13.

Moreover, a vent plate may take various shapes and need not be flat or have a tear-drop shaped perimeter. For example, a vent plate may have a circular perimeter and may be generally convex. A filter cover may be shaped as a dome, or some other continuous structure, in which case, a cover exterior and/or interior wall may be omitted, insofar as the interior of the dome may interface directly with a filter base.

Filter cover 12 is preferably constructed in a single injection molding operation. Construction by a single injection molding operation is advantageous as compared to manufacturing each component separately for a variety of reasons. First, manufacturing efficiency is increased insofar as only one mold is needed and time and resources are not wasted by assembling multiple component parts. Second, a single injection molding operation may produce an item with greater structural integrity, compared to an item constructed by bonding or welding multiple components together. Nonetheless, filter cover 12 may be manufactured in a plurality of component parts and subsequently assembled using various methods of bonding or welding. Moreover, a variety of manufacturing techniques, such as, for example, diecasting, may be used in manufacturing filter cover 12.

Filter cover 12 is preferably constructed from medical grade polycarbonate. Medical grade polycarbonate is rigid, impact resistant, heat resistant, and translucent. Medical grade polycarbonate is therefore suitable for protecting filter 13 from damage, for frequent use, and for disinfecting. Moreover, users may be better able to visually monitor the status of filter 13 due to translucence of filter cover 12. Filter cover 12 may be constructed from various other materials, although thermoplastics such as acrylonitrile butadiene styrene may be particularly well suited.

A filter base may be a structure that protects a filtration medium, interfaces with a filter cover to house a filtration medium, and interfaces with a facepiece. A filter base may also stabilize a filtration medium in place.

Figure 6:
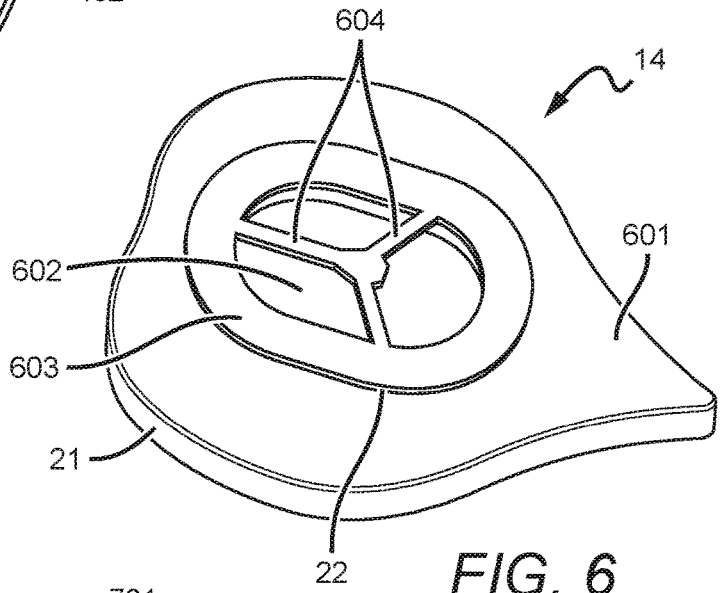
FIG. 6 is a front perspective view of a filter base.
Figure 7:
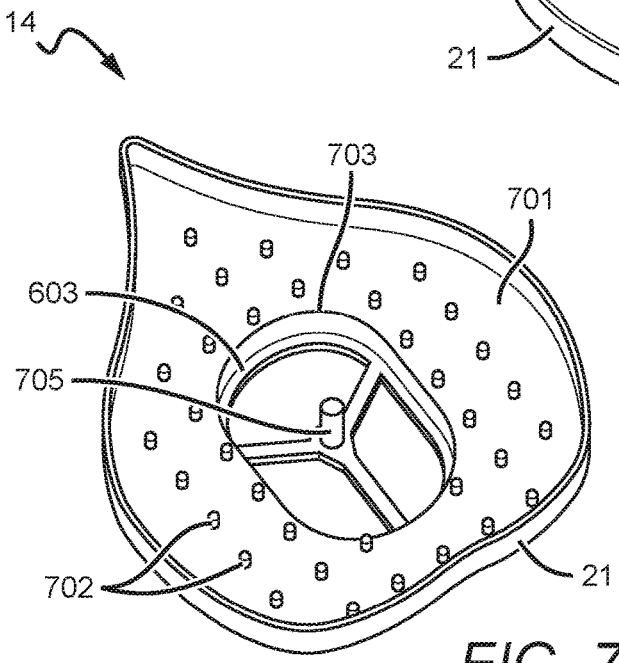
FIG. 7 is a rear perspective view of a filter base.
Figure 8:
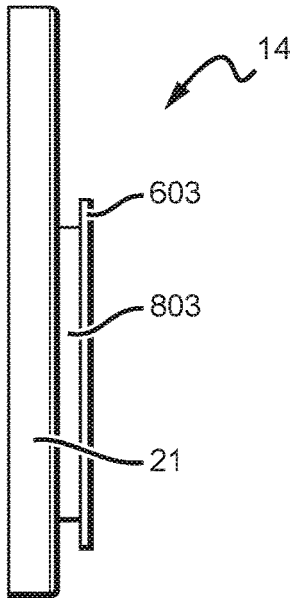
FIG. 8 is a side view of a filter base.

FIGS. 6-8 illustrate filter base 14, a preferred embodiment of a filter base. Base plate 20 is a plate with a generally teardrop shaped perimeter. Base plate's 20 perimeter is bounded by base wall 21. The height of base wall 21 extends substantially perpendicularly from base plate 14. Base plate 20 comprises an exterior face 601, interior face 701, a base vent 703, and stabilizing protrusions 702. Stabilizing protrusions 702, protrude perpendicularly from interior face 701 and serve the same function as stabilizing protrusions 404, but may vary in size, shape, and number, or may be omitted, as noted above with respect to stabilizing protrusions 404. Base vent 703 is preferably an oblong opening in base plate 20, through which air may pass.

As noted above with respect to the filter cover, a filter base may be of a variety of shapes and need not be generally teardrop shaped. However, filter cover and filter base are adapted to removably couple to house a filtration medium in such a manner that air passes through said filtration medium and does not escape through the interface of filter cover and filter base. Therefore, it is generally preferable that filter cover and filter base have perimeters that are substantially similar in shape. On the other hand, filter cover and filter base could be connected through one or more intermediary components, which would allow the perimeters of filter cover and filter base not to be substantially similar in shape.

A facepiece interface facilitates the removable coupling of a filter base and a facepiece, forming a substantially airtight seal. A preferred embodiment of a facepiece interface, facepiece interface 22, comprises facepiece interface plate 603, facepiece interface wall 803, and facepiece interface opening 602. Facepiece interface plate 603 is an oblong plate comprising an exterior face, an interior face, an opening, radial spokes 604, and molding protrusion 705. Facepiece interface wall 803 has a generally oblong perimeter of substantially similar dimensions as base vent 703, which in turn is substantially similar in dimension to facepiece interface opening 602. The height of facepiece interface wall extends between and connects facepiece interface plate 603 and base vent 703, creating a substantially airtight channel through which air may flow. A plurality of radial spokes 604 extend radially inward from facepiece interface opening 602, forming a central hub, from which molding protrusion 705 protrudes axially.

Filter base 14 and facepiece 15 may interface in various manners and specific components set forth herein, including facepiece interface 22 may be modified and omitted, so long as facepiece 15 and filter base 14 interface to form a substantially airtight seal. Alternatively, filter base 14 and facepiece 15 could be constructed as a single component, obviating the need for an interface between the two.

Filter base 14 is preferably constructed in a single injection molding operation and is preferably constructed from medical grade polycarbonate. The advantages of such construction, as well as alternatives to such construction are discussed above with respect to filter cover 12. Radial spokes 604 and molding protrusion 705 may be omitted, insofar as they are a byproduct of the injection molding process and may not be necessary for the structure or function of the mask.

Figure 9A:
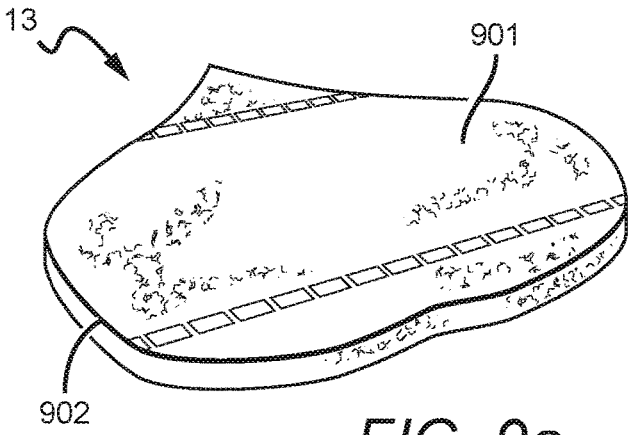
FIG. 9*a* is a rear perspective view of a filter.
Figure 9B:
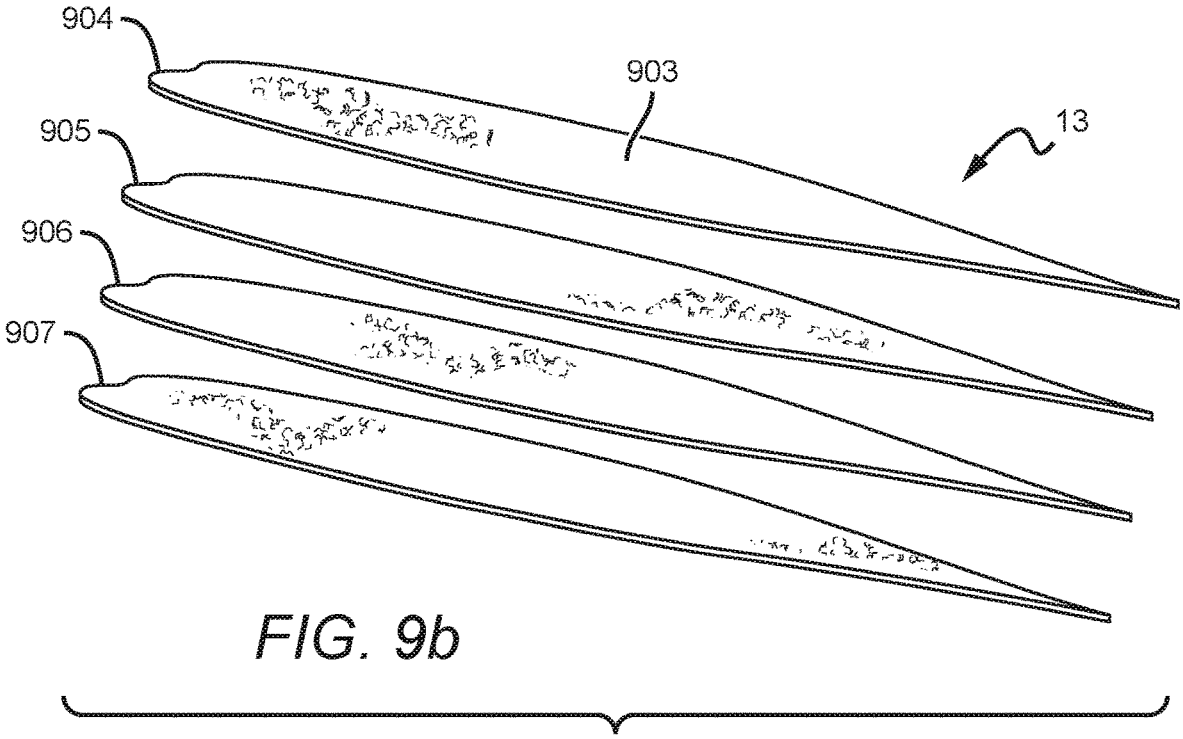
FIG. 9*b* is an exploded side perspective view of a filter.

A filter may be a medium for filtering particles and/or pathogens from inhaled and/or exhaled air. FIGS. 9*a*-9*b* illustrate filter 13, a preferred embodiment of a filter. Filter 13 comprises a front surface 903, a rear surface 901, and a perimeter 902. The perimeter 902 of filter 13 is preferably of similar shape and dimensions as the perimeter of cover interior wall 19, such that the perimeter of filter 13 may rest within the perimeter of cover interior wall 19. Filter 13 and cover interior wall 19 are preferably configured so that inhaled air passes through filter 13, as opposed to passing through any gaps between filter 13 and cover interior wall 19.

Filter 13 may be comprised of one or more layers of filtration medium. FIG. 9*b* is an exploded view showing multiple layers of filtration medium 904, 905, 906, and 907. Preferably filter 13 comprises at least a non-woven layer, a meltblown cloth layer, an electrostatic cotton layer, and a bactericidal layer. Various filtration mediums, layering structures, and filtration arrays are known in the art. Such, mediums, layering structures, and filtration arrays may be substituted for or combined with filter 13 to achieve various filtration goals. For example, a bactericidal layer may not be desired if the mask is worn for industrial applications in which pathogens are not a concern.

Figure 10:
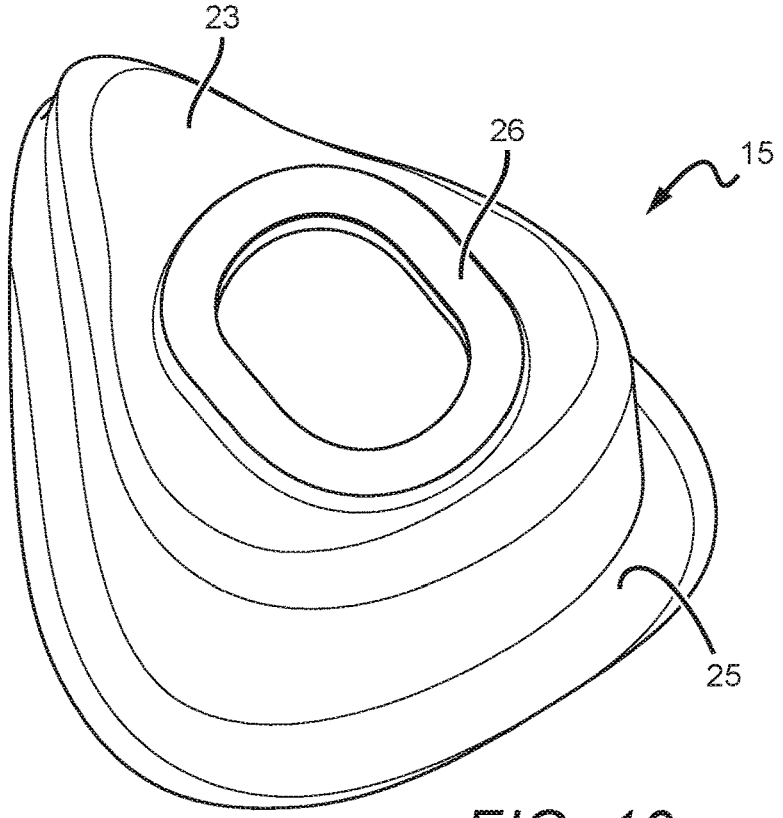
FIG. 10 is a front perspective view of a facepiece.
Figure 11:
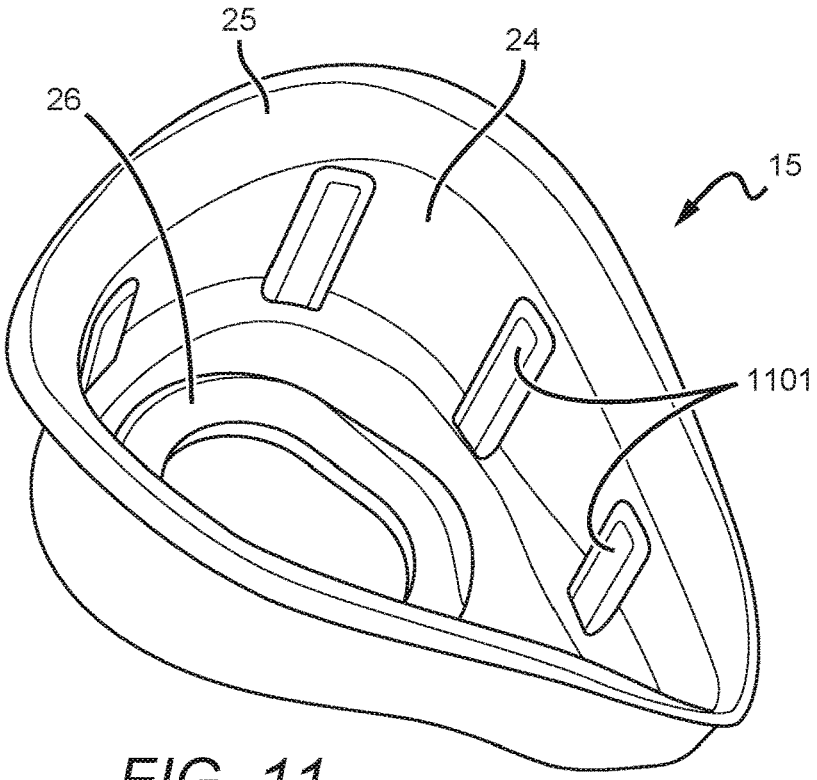
FIG. 11 is a rear perspective view of a facepiece.

A facepiece may be a structure that interfaces with the face of a user to form a substantially airtight seal. A facepiece may also interface with a filter base to form a substantially airtight seal. FIGS. 10-11 illustrate a facepiece 15, a preferred embodiment of a facepiece. Facepiece 15 comprises inner surface 24, outer surface 23, periphery 25, and filter base interface 26. Outer surface 23 and inner surface 24 are respectively convex and concave. Facepiece 15 may is configured to receive the nose, mouth, and chin of the wearer into the facepiece cavity bounded by inner surface 24. Facepiece 15 may be generally pear or teardrop shaped. Periphery 25 is configured to be pressed against the face of a person and form a substantially airtight seal. The thickness of periphery 25 may be less than the thickness of other portions of facepiece 15 to allow for increased flexibility and deformation. Periphery 25 may be further characterized as deformable upon the application of moderate force.

Inner surface 24 further comprises structural supports 1101. Structural supports 1101 may be raised portions of inner surface 24 that add thickness and structural integrity to various portions of facepiece 15. Structural supports 1101 may be omitted if the thickness and materials of facepiece 15 are sufficient in and of themselves to maintain the structural stability of facepiece 15. Filter base interface 26 is a portion of facepiece 15 with a generally greater thickness than the thickness of other portions of facepiece 15, except for structural supports 1101. Filter base interface 26 further comprises an opening. Filter base interface 26 may be generally an oblong ring with a flat outer and inner surface. Filter base interface 26 is configured to interface with facepiece interface 22. In an embodiment, the perimeter of the opening in filter base interface 26 is of substantially similar shape and dimensions as the perimeter of the exterior of facepiece interface wall 803, such that they form a substantially airtight seal when coupled. It should be appreciated that filter base interface 26, facepiece interface 22, and base vent 703 may be a variety of shapes, as opposed to oblong. For example, such components may all be annular or square, so long as the components are configured to couple to create a substantially airtight channel between filter base 14 and facepiece 15.

Facepiece 15 is preferably constructed in a single diecasting operation. Construction by a single operation is advantageous for the reasons set forth above with respect to filter cover 12. Nonetheless, facepiece 15 may be manufactured in a plurality of component parts and subsequently assembled using various methods of bonding or welding. There may be advantages to constructing periphery 25 separately from the remainder of facepiece 15, insofar as periphery 25 could be constructed of more flexible material than the remainder of facepiece 15. Moreover, a variety of manufacturing techniques, such as, for example, injection molding, may be used in manufacturing facepiece 15.

Facepiece 15 is preferably constructed of silicone or a silicone-based polymer. Silicone is generally heat resistant, which allows for facepiece 15 to be disinfected and cleaned using hot water. Silicone is further flexible and deformable, allowing facepiece to deform under moderate pressure to form a substantially airtight seal with the face of the user. Respirator masks are known in the art and utilize a variety of structures and materials to interface with the face of a user. For examples, facepiece 15 may be constructed of rubber or latex. It should be appreciated that some such structures or materials could be combined with filter base interface 26 to produce alternative embodiments of facepiece 15.

Figure 12:
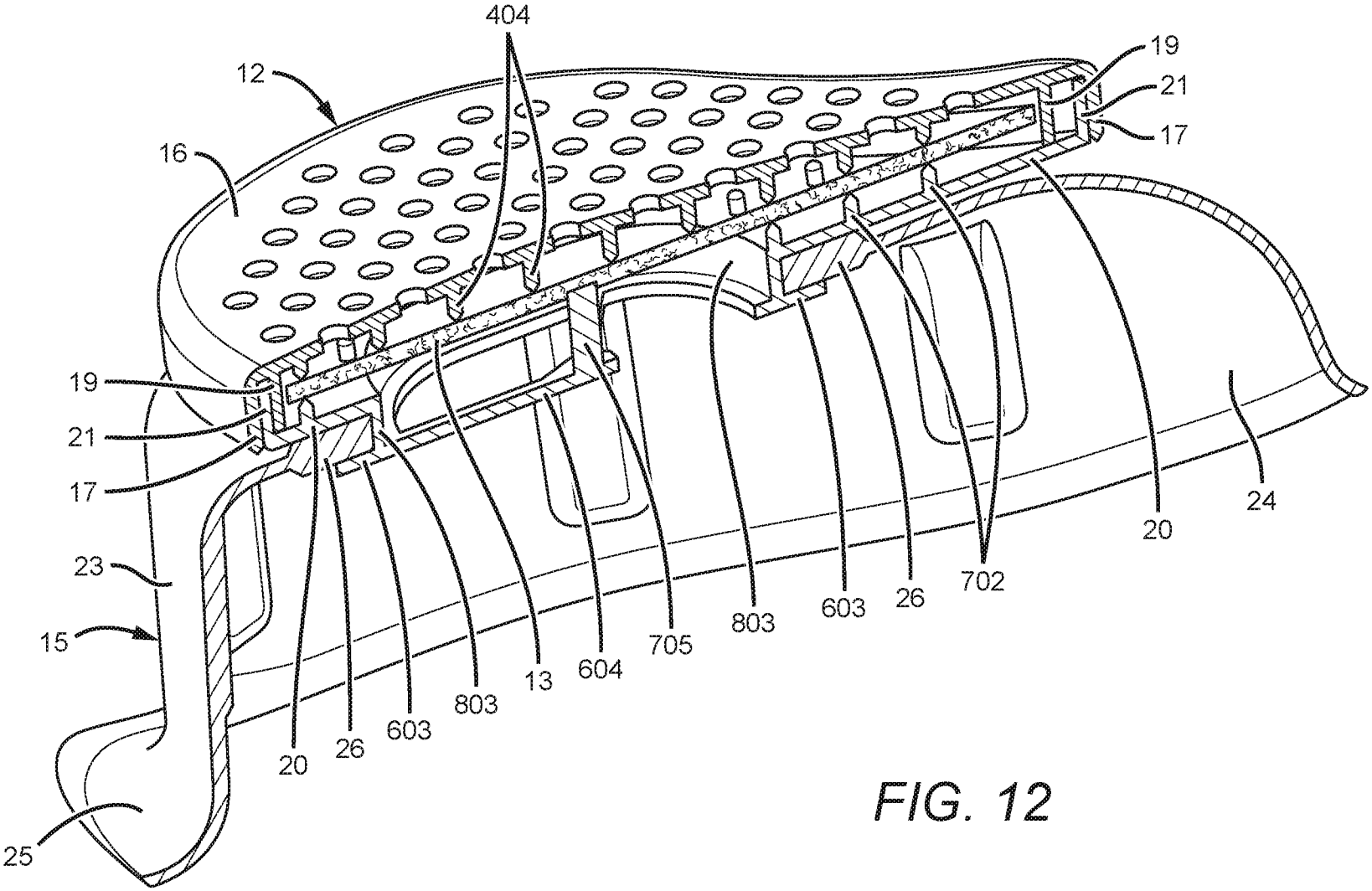
FIG. 12 is a partial cross-sectional view of a two-way respirator mask.

FIG. 12 illustrates a partial cross-sectional view of a two-way respirator mask. In preferred embodiments, filter cover 12 is removably coupled to filter base 14. Said coupling may be formed by base wall 21 sliding into the wall cavity defined by the separation between cover outside wall 17 and cover inside wall 19. Preferably the separation between cover outside wall 17 and cover inside wall 19 is substantially similar to the thickness of base wall 21, such that base wall 21 is encapsulated by the interior surface of cover outside wall 17 and the exterior surface of cover interior wall 19. Said coupling is preferably substantially airtight. When coupled, a cavity bounded by filter cover 12 and filter base 14 is formed. Filter 13 may be removably placed in this filter cavity and may be secured by stabilizing protrusions 404 and 702. Filter cover 12 and filter base 14 may be decoupled by the user to replace filter 13 and to clean the mask.

Filter cover 12 and filter base 14 may be removably coupled using various coupling means. For example, if the friction between the interior surface of cover outside wall 17 and the exterior surface of base wall 21 is sufficient for coupling, cover interior wall 19 may be omitted. Various configurations of latches may also be employed to removably couple filter cover 12 and filter base 14. If filter cover 12 and base plate 14 are annular, threading may be applied to the interior surface of cover outside wall 17 and the exterior surface of base wall 21, allowing filter cover 12 and filter base 14 to screw together, again allowing for the omission of interior wall 19. Filter cover 12 and filter base 14 could also be designed to snap together.

In preferred embodiments, filter base 14 is removably coupled with facepiece 15. Said coupling is formed by the interface between filter base interface 26, facepiece interface 603, facepiece interface wall 803, and base plate 20. In particular, filter base interface 26 is encapsulated by the exterior face of base plate 20, the exterior face of facepiece interface wall 803, and the interior face of facepiece interface plate 603. Said coupling is preferably airtight. Facepiece interface 22 may need to be deformed to effect said coupling, insofar as the external perimeter of facepiece interface plate 603 is greater than the internal perimeter of filter base interface 26. Filter base 14 and facepiece 15 may be decoupled by the user to clean the mask.

As noted above with respect to the coupling of filter cover 12 and filter base 14, the removable coupling of facepiece 15 and filter base 14 may be accomplished using a variety of means. Furthermore, facepiece 15 and filter base 14 may be constructed as one component. An advantage of constructing facepiece 15 and filter base 14 as separate components is deformable material may be used for facepiece 15, while rigid material may be used for filter base 14. However, manufacturing efficiency may increase by performing a single diecasting or injection molding operating for both facepiece 15 and filter base 14.

Figure 13:
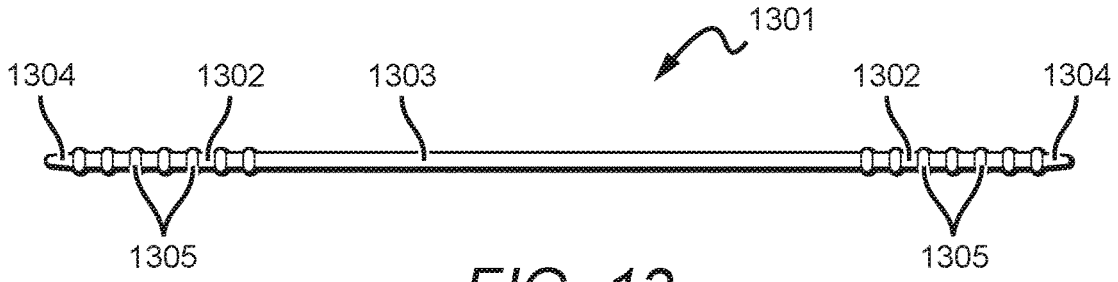
FIG. 13 is a side view of a first embodiment of a harness strap.
Figure 14:
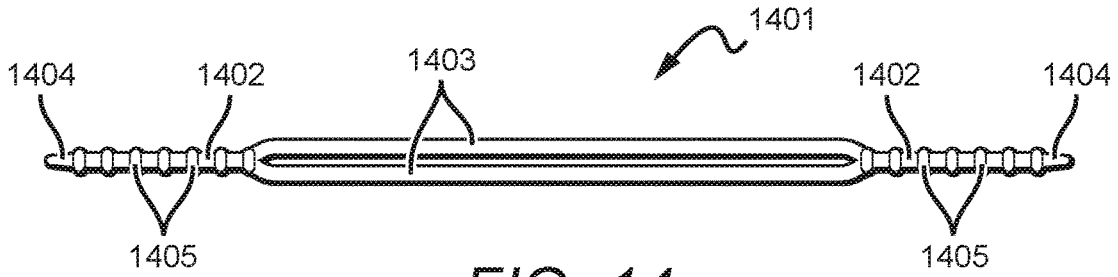
FIG. 14 is a side view of a second embodiment of a harness strap.

A harness strap may be a structure that removable affixes the mask to the face of a user. FIG. 13 is an illustration of a preferred embodiment of a harness strap 1301 and FIG. 14 is an illustration of an alternative embodiment of a harness strap 1401. Harness strap 1301 comprises two end portions 1302 and a middle portion 1303. Each end portion 1302 further comprises a tapered tip 1304 and strap protrusions 1305. End portions 1302 are configured to be received by the channels formed by lugs 18. Strap protrusions 1305 are slightly larger than the channels of lugs 18, such that strap protrusions 1305 may only pass through such channels if deformed. In an alternative embodiment, harness strap 1401 comprises two end portions 1402 and a middle portion 1403. In the alternative embodiment, middle portion 1403 comprises two, substantially parallel straps. Each end portion 1402 further comprises a tapered tip 1404 and strap protrusions 1405. End portions 1402 are configured to be received by the channels formed by lugs 18. Strap protrusions 1405 are slightly larger than the channels of lugs 18, such that strap protrusions 1405 may only pass through such channels if deformed.

Harness straps 1301 and 1401 are preferably constructed by a single die casting operation and are constructed from silicone or a silicone polymer. The advantages and alternatives to said construction are discussed above with respect to facepiece 15. Harness straps 1301 and 1401 may be constructed of a flexible, elastic material. Harness straps are well known in the art and are used for respirator masks, aquatic goggles, and other face coverings. It should be appreciated that a variety of harness straps and means for connecting harness straps to the mask may be suitable. Further, harness straps may be connected to facepiece 15 or base cover 14, as opposed to filter cover 12. An advantage of connecting harness straps to filter cover 12 is that the force created by harness straps helps maintain the coupling of filter cover 12 with filter base 14 while also creating force between periphery 25 and the face of the user.

Various methods of removably affixing the mask to the face of the user may be employed as an alternative or in addition to a harness strap. For example, elastic string, which may be less expensive and lighter than a silicone strap, may be attached to the mask and wrapped around the head of the user, the elasticity of the string generating pressure. Similarly, bands with elastic properties may be permanently attached to the mask, and may not require adjustment. It should also be appreciated that the mask need not have lugs, or such lugs may be placed on different components of the mask. For example, if rubber bands are permanently attached to the mask, lugs may be omitted. Alternatively, lugs may be a component of a filter base or a facepiece, as opposed to being a component of a filter cover. Finally, the mask may generate suction that affixes the mask to the face of the user or be affixed to the face of the user with adhesive, obviating the need for a harness strap of lugs.

Figure 15:
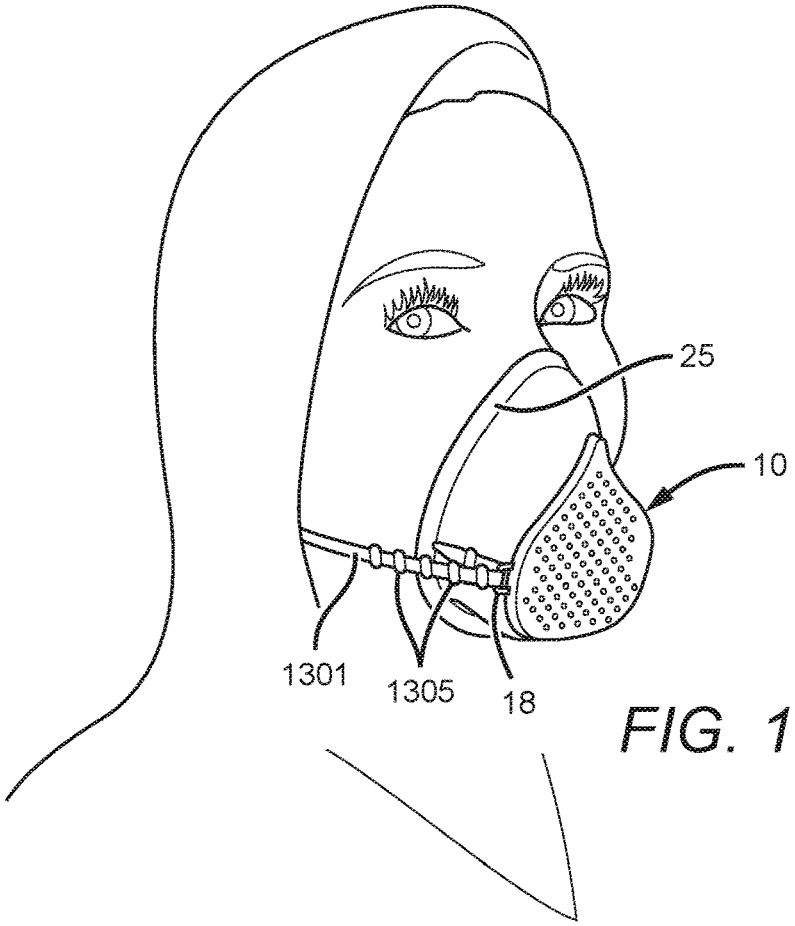
FIG. 15 is an illustration of a user wearing a two-way respirator mask.

FIG. 15 is an illustration of a user wearing a two-way respirator mask with harness strap 1301. End portions 1302 are passed through the channels of lugs 18 and middle portion 1303 rests on the back of the user's head. End portions 1302 are secured by the interface between lugs 18 and strap protrusions 1305. The elasticity of harness strap 1301 presses periphery 25 against the face of the user, causing periphery 25 to deform, thereby conforming to the face of the user and creating a substantially airtight seal.

Upon inhalation, air will pass from the external environment, through vent holes 402, through filter 13, though base vent 703, into the facepiece cavity and into the mouth or nose of the user. Upon exhalation, air will pass from the mouth or nose of the user into the facepiece cavity, through base vent 703, through filter 13, through vent holes 402, and out to the external environment. An additional advantage of the mask is that fogging of glasses or goggles is reduced, insofar as exhaled air is expelled through the vent holes 402, as opposed to seeping out through the interface between the mask and the user's face.

In preferred embodiments, mask 10 is configured such that the user's mouth is directly behind base vent 703, allowing air to more efficiently pass through filter 13.

In preferred embodiments, substantially all of the interface between the user's face and mask 10 occurs at periphery 25. Contact between the face of the user and inner surface 24 may be minimal or entirely absent, allowing the user to move their mouth more easily, thereby enhancing the user's ability to talk and breath while wearing the mask 10.

Although the present technology has been described in detail for the purpose of illustration based on what is currently considered to be the most practical and preferred implementations, it is to be understood that such detail is solely for that purpose and that the technology is not limited to the disclosed implementations that are within the spirit and scope of the appended claims. For example, it is to be understood that the present technology contemplates that, to the extent possible, one or more features of any implementation can be combined with one or more features of any other implementation.

What is claimed is:

1. A respirator mask configured to filter the inhalations and exhalations of a user, comprising:

a. a filter cover comprising a vent plate, an outside wall, and an inside wall;

i. wherein said vent plate has an exterior face, an interior face, and a perimeter;

1. wherein said outside wall has a height and a perimeter and said vent plate's perimeter is bounded by said outside wall;

2. wherein said height of said outside wall extends substantially orthogonally from said vent plate;

3. wherein said inside wall has a height and a perimeter and said inside wall is attached to said interior face of said vent plate with said height of said interior wall extending substantially orthogonally from said interior face of said vent plate;

4. wherein said perimeter of said inside wall is contained within said perimeter of said outside wall, with said outside wall and said inside wall defining a wall cavity with a first thickness;

b. a filter base removably coupled to said filter cover, said filter cover and said filter base defining a filter cavity configured to house a filter medium;

i. wherein said filter base comprises a base plate with a perimeter and a wall with a height;

ii. wherein said perimeter of said base plate is bounded by said wall of said filter base with said height of said wall of said filter base extending substantially orthogonally from said base plate;

iii. wherein said wall of said filter base has a second thickness;

iv. wherein said second thickness is substantially similar to said first thickness and wherein said filter cover and said filter base are configured to removably couple by sliding said base wall into said wall cavity;

c. a filter medium, removably housed in said filter cavity; and d. a facepiece;

i. wherein said facepiece is coupled to said filter base.

2. The respirator mask of claim 1, wherein said filter cover comprises a plurality of means for receiving and securing a harness strap; wherein said harness strap is configured to removably affix said respirator mask to said face of said user.

3. The respirator mask of claim 1 wherein said filter cover, said filter base, and said filter comprise perimeters that are substantially teardrop shaped.

4. The respirator mask of claim 1, wherein said filter cover and said filter base are constructed of medical grade polycarbonate.

5. The respirator mask of claim 1, wherein said filter cover is an integral whole.

6. The respirator mask of claim 1, wherein said filter base is an integral whole.

* * * * *